US006527630B2

(12) United States Patent
Mannsperger et al.

(10) Patent No.: US 6,527,630 B2
(45) Date of Patent: Mar. 4, 2003

(54) ELECTRICAL HAND TOOL, IN PARTICULAR ANGLE SANDER WITH ROTATABLE MAINTENANCE OPENING

(75) Inventors: Reiner Mannsperger, Plochingen (DE); Thomas Tiefenbach, Dettingen/Erms (DE)

(73) Assignee: Metabowerke GmbH & Co., Nurtingen (DE)

( * ) Notice: Subject to any disclaimer, the term of this patent is extended or adjusted under 35 U.S.C. 154(b) by 69 days.

(21) Appl. No.: 09/732,895

(22) Filed: Dec. 11, 2000

(65) Prior Publication Data

US 2001/0014576 A1 Aug. 16, 2001

(30) Foreign Application Priority Data

Dec. 11, 1999 (DE) ..... 199 59 920

(51) Int. Cl.[7] ..... B24B 23/00

(52) U.S. Cl. ..... 451/344; 451/259; 451/358; 451/359; 451/451; 30/500

(58) Field of Search ..... 451/259, 344, 451/358, 359, 451; 30/500

(56) References Cited

U.S. PATENT DOCUMENTS 5,347,765 A * 9/1994 Mixon, Jr. ..... 451/28 R
5,794,300 A * 8/1998 McCracken et al. ..... 15/97
6,021,826 A * 2/2000 Daniell ..... 144/73

FOREIGN PATENT DOCUMENTS

DE 4022668 A1 1/1992

OTHER PUBLICATIONS

Weltneuheit: Der Sicherheits–Winkelschleifer, Prospect of the firm "Fein" of 1978.

* cited by examiner

*Primary Examiner*—Timothy V. Eley
*Assistant Examiner*—Shantese McDonald
(74) *Attorney, Agent, or Firm*—Jones, Tullar & Cooper, P.C.

(57) ABSTRACT

An electrical hand tool is proposed, whose handle, with is rotatably maintained on the motor housing, and has a maintenance opening. By means of this, the structural length of the hand tool is reduced, servicing is simplified and the production costs are lowered.

16 Claims, 4 Drawing Sheets

ELECTRICAL HAND TOOL, IN PARTICULAR ANGLE SANDER WITH ROTATABLE MAINTENANCE OPENING

FIELD OF THE INVENTION

The present invention relates to an electrical hand tool, in particular an angle sander, having a motor housing receiving an electrical drive mechanism, and with a housing element, which protrudes from the front face of the motor housing and is rotatably maintained on the motor housing.

BACKGROUND OF THE INVENTION

Electrical hand tools of the above mentioned type are known, for example, from DE German published application OS 40 22 668 A1. With these hand tools either the gear head or the handle are rotatably seated on the motor housing so that, depending on whether the user of the electrical hand tool is right- or left-handed, and depending on the position of use of the electrical hand tool, the handle can be rotated with respect to the housing, so that therefore ergonomically advantageous working is possible for all users and all positions of use.

It is disadvantageous in connection with the known electrical hand tools, that the structural length is too great because of the rotatable seating of the gear head or of the handle. Moreover, it is necessary to provide maintenance openings on the motor housing in order to be able to exchange parts subject to wear, such as carbon brushes, without having to disassemble the electrical drive mechanism. Trouble in regard to handling and a relatively complicated production of these electrical hand tools result from this.

OBJECT AND SUMMARY OF THE INVENTION

The object of the present invention is based on making available an electrical hand tool whose manipulation is improved and whose production and maintenance costs are reduced.

In accordance with the present invention, this object is attained by an electrical hand tool, in particular an angle sander, having a motor housing receiving an electrical drive mechanism, and with a housing element, which is rotatably maintained on the motor housing, wherein the housing element at least partially encloses the motor housing, and wherein the housing element has a maintenance opening in the area in which it encloses the motor housing.

Because the motor housing projects into the housing element, or is at least partially enclosed by it, the structural length is reduced and the manipulation of the electric hand tool in accordance with the present invention is improved by this. Moreover, it is possible to perform maintenance or simple repair work on the electrical drive mechanism simply and cost-effectively through the maintenance opening of the housing element. Because the housing element is rotatably maintained on the motor housing, one maintenance opening suffices for accessing the entire portion of the motor housing in the area enclosed by the housing element. In the end, the number of needed parts is reduced, and the mechanical load-bearing capacity of the hand tool is improved, since only one maintenance opening is required.

One embodiment of the. Present invention has an electrical drive mechanism with a commutator, wherein the housing element encloses the motor housing at least in the area of the commutator, so that the carbon brushes of the electrical drive mechanism, which as a rule are arranged offset by 180°, can be simply and cost-effectively replaced. In place of the two maintenance openings required in connection with known electric hand tools, only one maintenance opening is required with the electrical hand tool in accordance with the present invention.

A variation of the present invention provides that the maintenance opening can be closed off by means of a cover, so that dirt, dust and moisture cannot reach the area of the commutator.

Supplementing the present invention, it is provided that the maintenance opening is a recess, which is open toward the front face of the housing element facing the motor housing of the electrical drive mechanism, so that the manufacture of the housing element is simplified and therefore the production costs are further reduced.

In a further embodiment of the present invention it is provided that the housing element is made of two parts, and that the dividing plane divides the maintenance opening into two sections, so that the production of the two sections is simplified.

Variations of the present invention provide that the cover can be snapped into and/or screwed to one or both halves of the housing, as well as that the cover is pivotably seated on one of the two halves of the housing element. It is common to all of these embodiments that the fastening of the cover simultaneously fixes the two halves of the housing element to each other. Because of this, a fastening screw between the two halves of the housing element can be omitted, so that the number of parts is reduced and the production costs are further minimized. It can be particularly advantageous if for, example, the cover is snapped into one of the two halves and is screwed to the other half of the housing element, because a particularly simple and quick assembly and an assured fixation of the two housing halves, which can be stressed, is achieved by such a combination. If the cover is pivotably seated on both halves of the housing element, this prevents the loss of the cover when the maintenance opening must be opened for maintenance or repair purposes.

With another embodiment of the present invention, the housing element has means for sealing the interior of the housing element and the motor housing against dirt, dust and/or moisture in the area of the front facing the motor housing, so that the operational dependability and the service life of the electrical hand tool, in particular of the electrical drive mechanism, are increased.

In another form of the embodiment of the present invention, the housing element has at least one ventilation opening in the area of the commutator, so that cooling of the electrical drive mechanism is improved. With electrical hand tools of the prior art it is necessary to provide the maintenance openings closed with a cover in place of ventilation openings.

In a further embodiment of the present invention, the maintenance opening is arranged on the top or underside of the housing element, when the electrical hand tool is in a horizontal position of use, so that dust raised from the workpiece, or dust falling from above on the electrical hand tool, or the like, cannot enter the interior of the housing element, because as a rule the maintenance opening is closed off by a cover during operation.

In connection with a variation of the present it is provided that the ventilation opening or ventilation openings are arranged on one or both sides of the housing element, when the electrical hand tool is in a horizontal position of use, so that the grinding dust lying on the workpiece or the like is not raised, and furthermore the air flow passing through the ventilation openings is not blown directly on the user.

A form of embodiment of the present invention provides that the housing element is a gear head with a tool receiver, so that no electrical connections or electrical lines must follow the rotary movement of the housing element in relation to the electrical drive mechanism, and therefore a high functional dependability is achieved.

In another embodiment of the present invention the housing element is a handle, in particular with a switch panel for switching the electrical drive mechanism on, so that the connection between the gear head and the electrical drive mechanism can be designed to be especially rigid.

A further embodiment of thee present invention provides that the housing element has at least one radially projecting collar, which engages at least one circumferential groove in the motor housing, so that large forces, or moments, can be transmitted between the motor housing and the housing element.

Further advantages and advantageous embodiments of the present invention can be taken from the following description, the drawings and the claims. An exemplary embodiment of the subject of the present invention is represented in the drawings and explained in greater detail in what follows.

DETAILED DESCRIPTION OF THE EXEMPLARY EMBODIMENT

Figure 1:
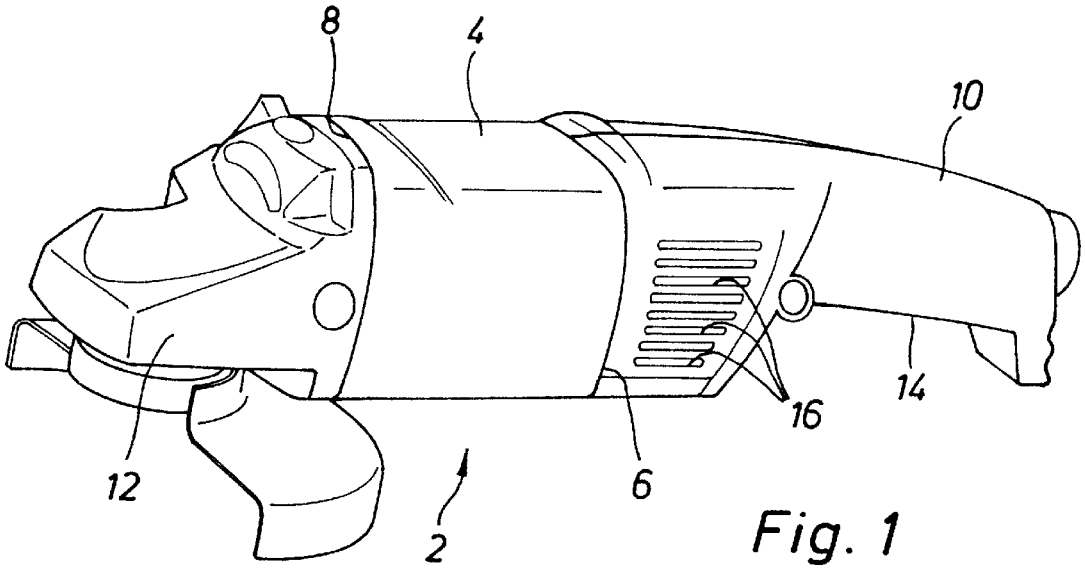
FIG. 1 shows an embodiment of an electrical hand tool in accordance with the present invention in a horizontal position of use.

An angle sander 2 in accordance with the present invention is represented in FIG. 1. A motor housing 4 with a first front face 6 and a second front face 8 is located in the center of the angle sander 2. A handle 10 on the first front face 6 is rotatably connected with the motor housing 4. A gear head 12 is fixedly connected with the motor housing 4 on the second front face 8. On its underside, the handle 10 has a switch panel 14, which is used for switching the electrical drive mechanism located in the motor housing 4 on and off. On its end facing the first front face 6, the handle 10 partially encloses the motor housing 4. The commutator and the carbon brushes of the electrical drive mechanism located in the motor housing 4 are located in this area of the motor housing 4. The commutator and the carbon brushes are not visible in FIG. 1. In order to achieve the best possible cooling of the electrical drive mechanism, ventilation openings 16 are arranged laterally in the area of the handle 10, which encloses the commutator and the carbon brushes. It can be clearly seen in this representation that the total structural length of the angle sander is reduced by partially pushing the motor housing 4 and the handle 10 into each other, while an optimal guidance of the cooling air is simultaneously possible.

Figure 2:
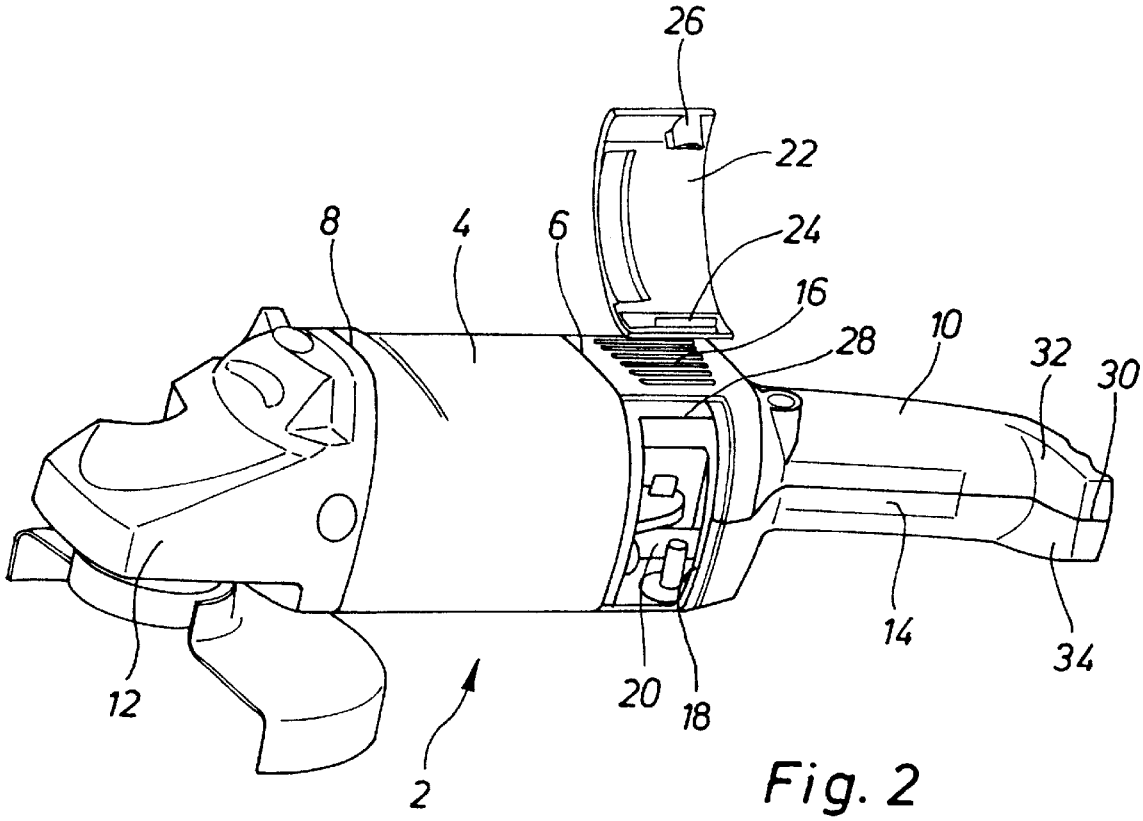
FIG. 2 shows the electrical hand tool in accordance with FIG. 1 with a handle turned by 90°.

The angle sander 2 is represented in the same position of use in FIG. 2. Only the handle 10 has been rotated by approximately 90° in relation to the motor housing 4 in comparison with FIG. 1. The switch panel 14 on the underside of the handle 10 can be clearly seen in this position. Furthermore, a maintenance opening 18, designed as an open recess, can be seen on the front face of the handle facing the motor housing 4. The opened maintenance opening 18 permits access to the carbon brushes 20 of the electrical drive mechanism located in the motor housing 4. If the handle 10 is further rotated by approximately 180°, the carbon brushes located on the other side of the electrical drive mechanism are also accessible. Therefore all carbon brushes 20 of the electrical drive mechanism can be serviced, or replaced, through this maintenance opening 18 in the handle 10, which is rotatably maintained on the motor housing 4. So that neither dirt nor moisture can reach the interior of the motor housing 4 or of the handle 10 during operation, the maintenance opening is closed off by a cover 22 during operation. The embodiment of the cover 22 represented has a snap-in strip 24 on its one end, and a through-bore 26 for a fastening screw, not represented, on its other end. For fastening the cover 22 to the handle 10, the snap-in strip 24 is suspended in a corresponding opposite element 28 in the handle 10 and is pivoted until the cover 22 rests on the handle 10. Subsequently a screw is inserted into the through-bore 26 and is screwed together with the handle 10.

In the embodiment represented in FIG. 2, the handle 10 is embodied in two parts. In FIG. 2, the plane of division extends approximately horizontally and divides the maintenance opening 18 into two sections. This means that the two halves 32 and 34 of the handle 10 are connected with each other simultaneously with the fastening of the cover 22 on the handle 10. The sturdiness of the handle 10 is increased by this, or one of the screws, not represented in FIG. 2, for connecting the two halves 32 and 34 can be omitted.

In connection with the embodiment represented in FIGS. 1 and 2 it is advantageous, that the number of components is reduced since, in contrast to the known electrical hand tools with one cover and one maintenance opening for each carbon brush, only one maintenance opening 18 and one cover 22 are required. Moreover, a connecting screw can be omitted. Finally, the embodiment in by accordance with the present invention of the motor housing 4 and the handle 10 also permits the placement of ventilation openings 16 in the area of the commutator, so that cooling is improved and therefore the service life of the electrical drive mechanism is extended.

Figure 3:
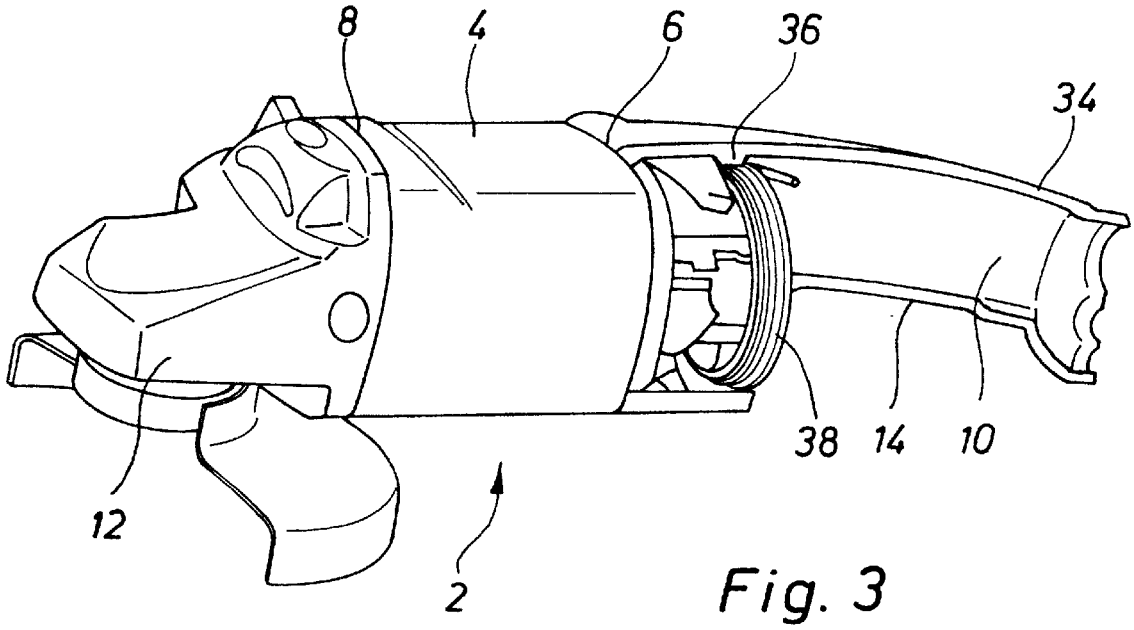
FIG. 3 shows the electrical hand tool in accordance with FIG. 1 with only one half of the handle.

The angle sander is represented in the same position of use in FIG. 3 as in FIG. 1, but with the difference that the half 32 of the handle 10 was removed. It can be clearly seen in this representation that the handle 10 has a radially projecting collar 38, which engages a circumferential groove 36 of the motor housing 10. Because of this it is possible to transmit strong forces between the handle 10 and the motor housing 4, while a twisting of the handle 10 in relation to the motor housing 4 is simultaneously possible.

It is of course possible to provide several collars 36 and circumferential grooves 38. Thus, it can be advantageous in particular to provide a further collar 36 and a further circumferential groove 38 in the area of the first front face 6 for improving the force transmission between the handle 10 and the motor housing 4, and moreover to achieve a seal against dust, grinding particles or moisture. From this point of view it is also practical that the cover 22, not represented here, has a collar on its end facing the first front face 6, which engages the circumferential groove located there.

In the case, not represented in the drawings, that the commutator of the electrical drive mechanism is arranged in the area of the second front end 8, it is of course also possible to rotatably connect the gear head 12 with the motor housing 4, wherein the gear head 12 then also has ventilation openings 16, as well as a maintenance opening 18 with a cover 22. The advantages arising from this arrangement essentially correspond to the advantages of the embodiment represented in FIGS. 1 to 5.

Figure 4:
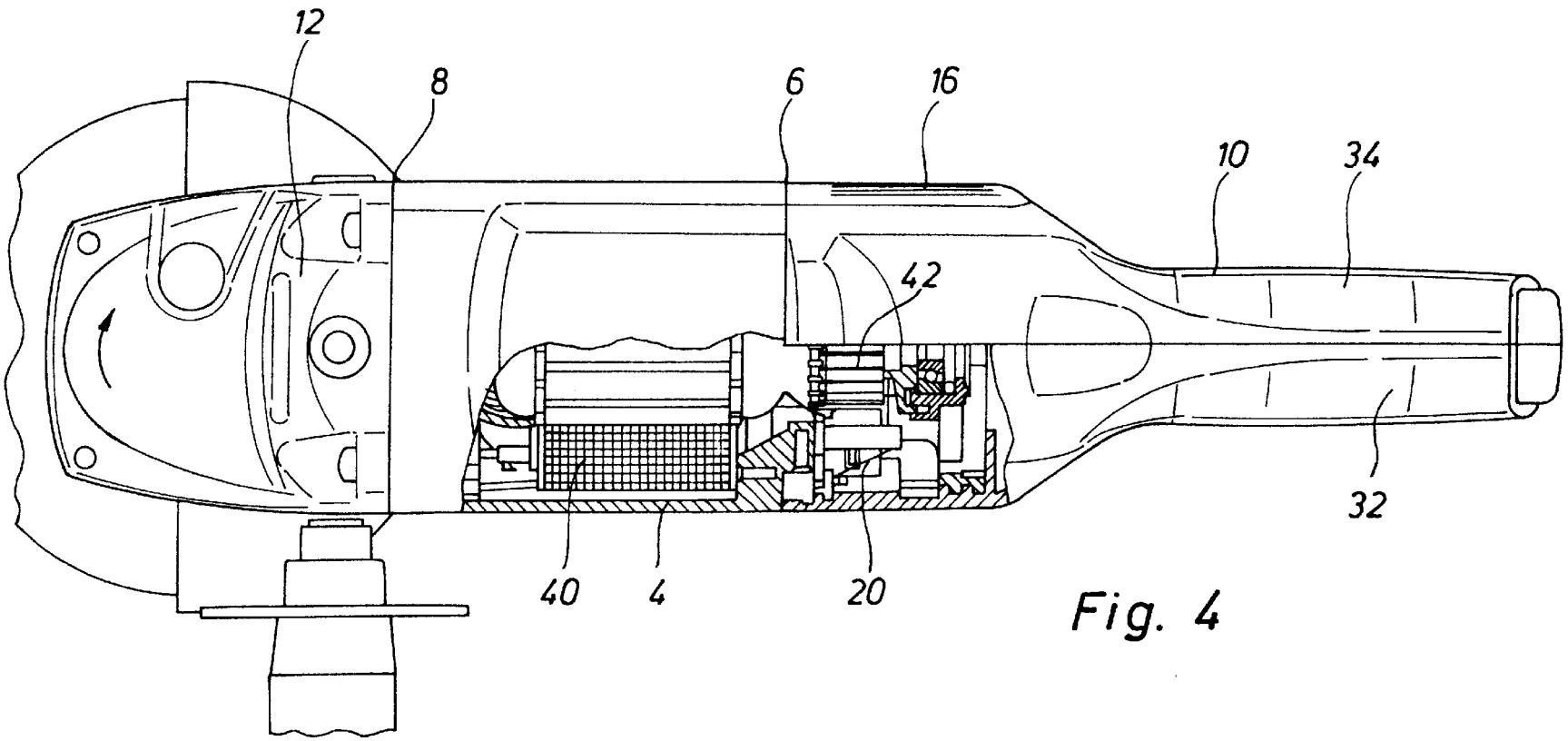
FIG. 4 is a top plan view of an electrical hand tool in accordance with FIG. 1.

FIG. 4 shows a partially cut top plan view of an angle sander 2 in accordance with the present invention. An electrical drive mechanism 40 with a commutator 42 and a carbon brush 20 can be seen in this top plan view. The maintenance opening is not visible in this view, because it is located on the underside of the handle 10.

Figure 5:
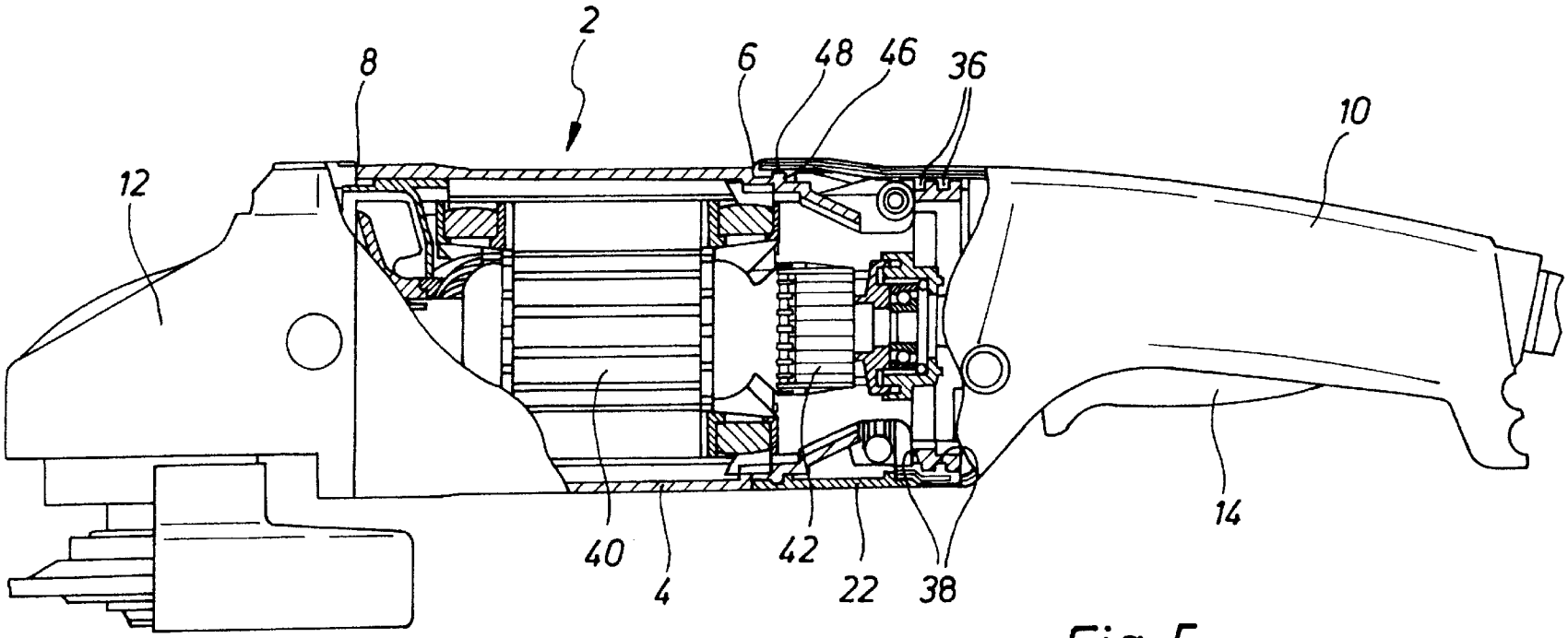
FIG. 5 is a longitudinal sectional view of an electrical hand tool in accordance with FIG. 1.

An angle sander 2 in accordance with the present invention is shown in longitudinal section in FIG. 5. The carbon brushes, which are arranged on the side, are not visible in this representation. It can be easily seen that the handle 10 has two collars 36, which engage the corresponding circumferential grooves 38 of the motor housing 4. The handle 10 is rotatably maintained in the motor housing 4 by this. It is of course also possible to provide a locking device, not represented in FIG. 5, for preventing the rotation of the handle 10 in relation to the motor housing 4 when the angle sander 2 is in operation.

The motor housing 4 has a radially projecting collar 46 in the area of the first front face 6, which engages a corresponding groove 48 in the handle 10. The connection between the handle 10 and the motor housing is further strengthened by this, and moreover the entry of dirt into the interior of the handle 10 and/or of the motor housing 4 is prevented. The cover 22 also has a groove corresponding to the groove 48, which can be engaged by the collar 46. The fact, that in the area of the first front face 6 the collar 46 is arranged on the motor housing 4 and the groove 48 in the handle 10, while at the end of the motor housing 4 two circumferential grooves 38 are arranged in the motor housing 4 and two collars 26 on the handle 10, is without significance for functioning. It is also conceivable to reverse the arrangement of grooves and collars.

Figure 6:
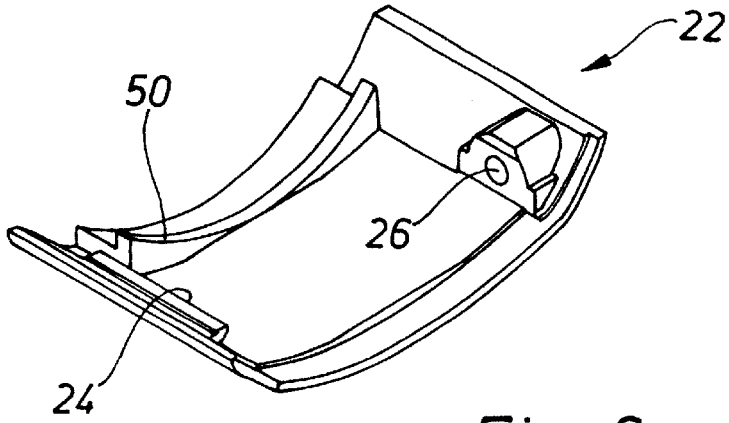
FIG. 6 shows an exemplary embodiment of a cover.

FIG. 6 represents a cover 22 for closing off the maintenance opening. A through-bore 26 is arranged opposite the snap-in strip 24, through which a screw, not represented, can be inserted and screwed together with the handle 10, not represented in FIG. 6. In the assembled state, the collar 50 engages the groove 48 of the motor housing.

The present invention is not limited to electrical hand tools with an electrical drive mechanism having a commutator, rather is it possible to service or repair other components or groups of components through the maintenance opening in accordance with the present invention.

All characteristics represented in the specification, the claims, which follow, and in the drawings can be important for the present invention individually, as well as in any arbitrary combination.

What is claimed is:

1. An electrical hand tool, comprising:

a motor housing;

an electrical drive mechanism received in said motor housing;

a housing element rotatably maintained on said motor housing, wherein:

said housing element, at least partially encloses, said motor housing, and wherein said housing element has a maintenance opening in the area in which it encloses said motor housing.

2. The electrical hand tool as defined in claim 1, wherein said electrical drive mechanism includes a commutator, and wherein said housing element encloses said motor housing, at least in the area of said commutator.

3. The electrical hand tool as defined in claim 2, wherein said housing element has at least one ventilation opening in the area of said commutator.

4. The electrical hand tool as defined in claim 3, wherein said at least one ventilation opening is arranged on one of: one side of said housing element and both sides of said housing element, when said electrical hand tool is in a position of operation.

5. The electrical hand tool as defined in claim 1, further comprising:

a cover, wherein said maintenance opening is closed off by said cover.

6. The electrical hand tool as defined in claim 1, wherein said housing element defines a front face facing said motor housing, and wherein said maintenance opening is a recess which is open toward said front face.

7. The electrical hand tool as defined in claim 1, wherein said housing element is made of two parts which together define a dividing plane, and wherein said dividing plane divides said maintenance opening into two sections.

8. The electrical hand tool as defined in claim 7, further comprising:

a cover, wherein said cover is snapped into one of: one half of said housing element and both halves of said housing element.

9. The electrical hand tool as defined in claim 7, further comprising:

a cover, wherein said cover is screwed to one of: one half of said housing element and both halves of said housing element.

10. The electrical hand tool as defined in claim 7, further comprising:

a cover, wherein said cover is pivotably seated on one of said two halves of said housing element.

11. The electrical hand tool as defined in claim 1, wherein said housing element defines a front face facing said motor housing, and wherein said housing element includes means for sealing the interior of said housing element and said motor housing against dirt, dust and/or moisture in the area of said front face.

12. The electrical hand tool as defined in claim 1, wherein said maintenance opening is arranged on one of: the top of said housing element and the underside of said housing element when said electrical hand tool is in a position of operation.

13. The electrical hand tool as defined in claim 1, wherein said housing element comprises a gear head supporting a tool receiver.

14. The electrical hand tool as defined in claim 1, wherein said housing element is a handle.

15. The electrical hand tool as defined in claim 14, wherein said handle includes a switch panel for switching the electrical drive on.

16. The electrical hand tool as defined in claim 1, wherein said housing element includes at least one radially projecting collar, said motor housing includes at least one circumferential groove, and said at least one radially projecting collar of said housing element engages said at least one circumferential groove of said motor housing.

* * * * *